US005509162A

United States Patent [19]

Burgoon

[11] Patent Number: 5,509,162

[45] Date of Patent: Apr. 23, 1996

[54] HINGED BRUSH RETAINING ARM FOR SWEEPERS

[75] Inventor: Jack L. Burgoon, Toledo, Ohio

[73] Assignee: Clarke Industries, Inc., St. Louis, Mo.

[21] Appl. No.: 343,654

[22] Filed: Nov. 22, 1994

[51] Int. Cl.[6] ..... A47L 11/24; E01H 1/04

[52] U.S. Cl. ..... 15/52.1; 15/83; 15/340.3

[58] Field of Search ..... 15/50.3, 52.1, 15/82, 83, 84, 340.2, 340.3, 340.4

[56] References Cited

U.S. PATENT DOCUMENTS

| | | | |
|---|---|---|---|
| 3,233,274 | 2/1966 | Kroll | 15/340 |
| 3,624,861 | 12/1971 | Freiheit | 15/320 |
| 3,979,789 | 9/1976 | Peabody et al. | 15/349 |
| 4,926,517 | 5/1990 | Smith | 15/82 |
| 5,231,725 | 8/1993 | Hennessey et al. | 15/83 |

*Primary Examiner*—Edward L. Roberts, Jr.
*Attorney, Agent, or Firm*—Senniger, Powers, Leavitt & Roedel

[57] ABSTRACT

A cylindrical brush of the type utilized in an industrial type sweeper is retained on one end by an idler broom arm. The idler broom arm is hingedly connected to a member transverse to the brush such that the broom arm swings outwardly from the brush to effect a brush change as the broom arm is pivotally retained. A latch retains the arm in its closed position. The hinge is located radially behind and axially outwardly relative to the brush. This offset location of the hinge creates an inward biasing of the broom arm during forward travel of the sweeper to retain the brush between the idler broom arm and the driven broom arm on the opposite side of the brush.

6 Claims, 4 Drawing Sheets

HINGED BRUSH RETAINING ARM FOR SWEEPERS

FIELD OF THE INVENTION

The present invention relates generally to industrial-type sweepers that utilize replaceable elongated cylindrical brushes, and more particularly is directed towards the retention of such brushes within industrial-type sweepers.

BACKGROUND OF THE INVENTION

Sweepers for cleaning streets and large areas, generally known as industrial-type sweepers or riding sweepers are well known in the art. Such sweepers generally use an elongated, cylindrical brush that rotates about its longitudinal axis. The brush includes rows of bristles for sweeping encountered debris into a hopper of the sweeper. Typically, the brush is mounted towards the front of the sweeper and rotates such that the bristles contact the surface to be swept in a direction opposite to the direction of sweeper travel. This throws the dirt and debris into a hopper portion integral with the sweeper housing.

The brush is also removable from its housing as use wears down the bristles. At the point of wear it is necessary to either replace the old brush with a new brush, or turn the old brush around such that its bristles will become worn from the opposite side.

In U.S. Pat. No. 3,284,830 issued to Kroll on Feb. 8, 1966 discloses a drive hub mounted to a door in the sweeper frame. When the door is opened, the brush is no longer supported by the hub. Thus the brush must somehow be realigned with the hub upon closing the door, since the hub is integral with the door.

U.S. Pat. No. 3,624,861 issued to Freiheit on Dec. 7, 1971 discloses a floor scrubber that has a changeable brush. The brush is housed within the scrubber unit. One side of the brush is retained by a pivoting arm and latch mechanism. While the pivot point is disposed radially behind the brush, the pivot point is in the same plane as the end face of the brush.

U.S. Pat. No. 3,979,789 issued to Peabody on Sep. 14, 1976 discloses a small sweeper with a cylindrical brush rotatably mounted between two arms that depend from opposite ends of a torsionally stiff transverse member. One of the two arms is formed from a flexible metal that extends from the transverse member and curves around the brush to retain an end of the brush. Mere hand pressure applied against the flexible arm will release the arm from the brush. In this manner the brush may be changed. However, such an arrangement is only suitable for light duty sweepers where a brush arm that is light enough to be sprung by hand is strong enough to retain the light duty brush.

U.S. Pat. No. 4,926,517 issued to Smith on May 22, 1990 is directed toward a sweeper that utilizes a cylindrical brush. One end of the brush is held by a pivoting arm. A hydraulic unit is attached to the end of the pivoting arm remote from the brush. The hydraulic unit retains the arm against the end of the brush and uncouples the same arm from the brush for changing the brush. Again, however, while the pivot is disposed radially behind the brush, the pivot is in the same plane as the end face of the brush.

In U.S. Pat. No. 5,231,725 issued to Hennessey et al. on Aug. 3, 1993, one of the arms, the idler arm, is completely detachable from the torsionally stiff transverse member through a latch mechanism. Therefore, each time the arm is removed, it is necessary to realign the brush and the arm before connection.

The prior art is replete with various brush holding mechanisms that permit brush change. However, these mechanisms are either unsuitable for such large industrial type sweepers and associated brushes, or are cumbersome in their operation or structure.

It is thus an object of the present invention to provide a brush retaining mechanism for an industrial sweeper that allows easy access to the brush in order to change or rotate the brush.

It is another object of the present invention to provide a brush retaining mechanism that permits quick alignment of the brush to the retaining mechanism.

It is yet another object of the present invention to provide a brush retaining mechanism that is not detachable from the sweeper.

SUMMARY OF THE INVENTION

The present invention provides a brush retaining mechanism having two brush arms, an idler arm and a drive arm, that retain the brush on either ends. One of the two brush arms is hingedly coupled to a support member spaced from and parallel to the cylindrical brush. An end of the hinged brush arm remote from the hinge is adapted to engage the end of the cylindrical brush. A passive keeper or active retaining mechanism such as a latch or the like abuts or holds the hinged brush arm against the end of the brush.

In one form, the keeper or retainer mechanism is integral with an access door in the sweeper frame such that the hinged arm is retained against the end of the brush when the door is in a closed position. A latch separate from the door may also hold the arm as well as a spring bias mechanism.

In this manner, the cylindrical brush engaging portion of the hinged brush arm is correctly and easily alignable with the end of the cylindrical brush without tools and without removal of the arm.

Furthermore, the hinge of the hinged brush arm is axially outwardly offset from a plane defined by the end of the brush. Thus, the forward movement of the sweeper and the rotation of the brush naturally bias the hinged arm axially inwardly against the end of the brush to maintain engagement of the hinged arm against the brush.

In one embodiment thereof, the present invention provides a brush retaining device comprising a door disposed in the sweeper frame adjacent the brush, a support fixed to the sweeper frame and disposed parallel to the brush, and a hinge connected to the support opposite said first brush arm. Further, a first brush arm is fixedly depending from the support and is adapted to engage a first end of the brush, with a second brush arm pivotally connected to the hinge and adapted to engage a second end of the brush. The second brush arm is retained against the second end by a passive keeper mechanism, the hinge located axially outwardly from the brush wherein the second brush arm is biased against the brush during forward movement of the sweeper.

BRIEF DESCRIPTION OF THE DRAWINGS

So that the manner in which the above-recited features, advantages, and objects of the present invention are attained and can be understood in detail, a more particular description of the invention, briefly summarized above, may be had by reference to the embodiments thereof which are illustrated in the appended drawings.

It is noted, however, that the appended drawings illustrate only a typical embodiment of this invention and is therefore not to be considered limiting of its scope, for the invention may admit to other equally effective embodiments. Reference the appended drawings, wherein.

DETAILED DESCRIPTION

Figure 1:
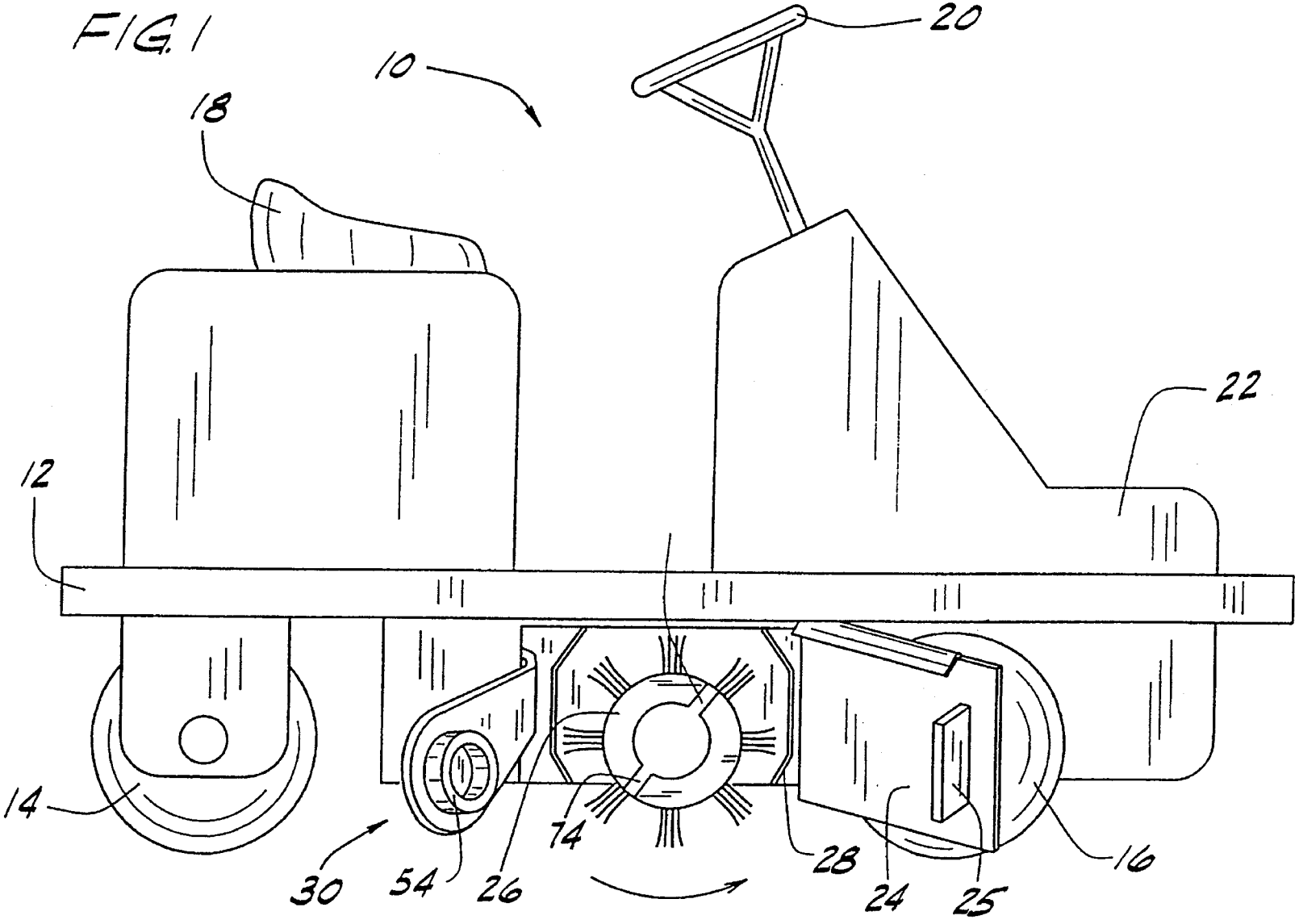
FIG. 1 is an elevational view of a typical industrial floor sweeper.

Referring now to FIG. 1, there is shown a typical industrial type riding sweeper 10 to which the present invention applies. The sweeper 10 includes a frame 12 that is supported upon a pair of front wheels of which only one such front wheel 16 is shown and a rear wheel 14. The sweeper 10 further includes, among other typical features, a seat 18 for the operator or driver, a steering wheel 20, and a hopper portion 22 disposed at the front end thereof.

Disposed between the front and rear wheels is a brush access door 24 that is hingedly coupled (See FIG. 3) to the frame 12. In the open position, the door 24 provides access to an elongated cylindrical brush or broom 26 as is typical in such sweepers 10. The brush 26 is held within a brush housing 28 rearwardly of the hopper 22 and between the front wheels 16 and the rear wheel 14. The brush is held by a brush support system for rotation about a generally horizontal axis A (see FIG. 2) extending in side-to-side direction with respect to the sweeper frame 12. This system includes a hinged broom or idler arm assembly 30, here shown in an open position, which supports one end of the brush 26 when engaged thereon as described in greater detail hereinbelow. The brush includes a central hollow core 27 and two diametrically opposed slots 72, 74. The slots 72, 74 are engaged by pins 64, 65 or similar type studs on the arm assembly 30 (see FIG. 4). The pins 64, 65 fit into the slots 64, 65 and provide proper alignment and engagement (coupling) of the (idler hub) hinged arm assembly 30 to the brush 26.

Figure 2:
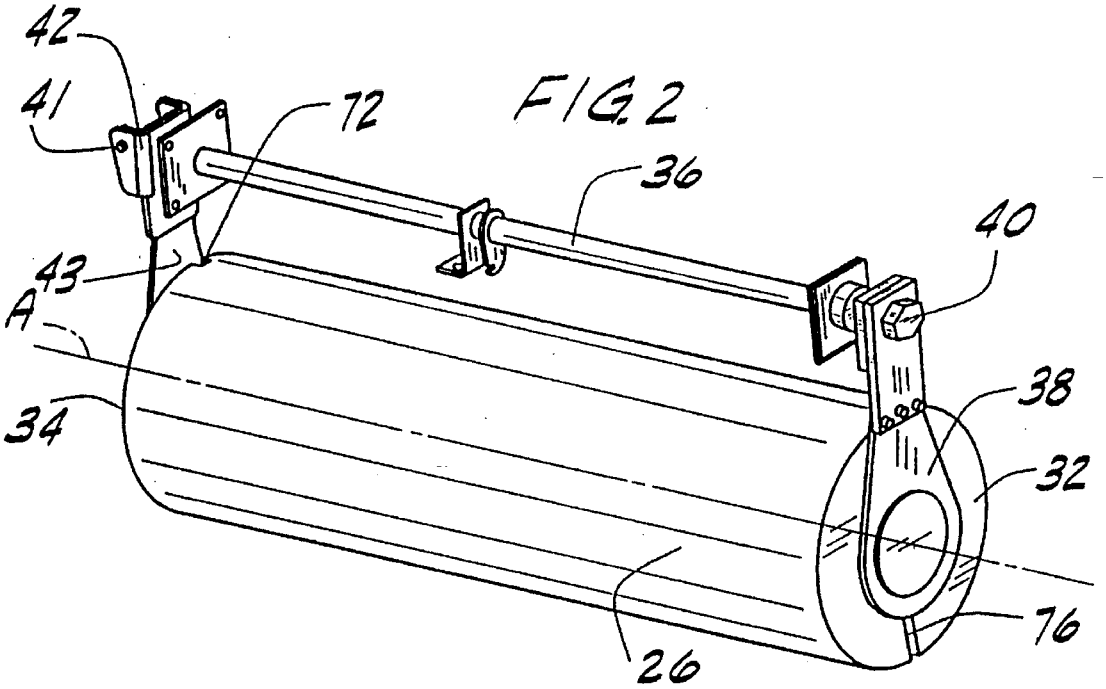
FIG. 2 is a perspective view of the cylindrical brush utilized in the sweeper of FIG. 1 and the present brush arm structure.

With reference now to FIG. 2, the brush 26 is shown, without bristles for clarity, as it would appear supported within the sweeper 10. A drive arm 38, which may be referred to as a first brush arm, is releasably coupled to the core 27 (see FIG. 1) at a first end 32 of the brush 26, which is the end opposite to the end exposed in FIG. 1 via slots, of which only one slot 76 is shown, and studs in similar manner to the idler arm 30. The drive arm 38 extends radially beyond the diameter of the brush 26 and is fixed at a coupling 40 to a support in the form of a horizontal rod 36. The rod 36 is fixed to the frame of the sweeper (not depicted in this view) and is disposed parallel to the brush 26, while extending substantially the longitudinal length of the brush 26. The idler arm assembly 30, which may be referred to as a second brush arm, is disposed at the other (second) end 34 of the brush and is coupled to the rod 36 by a hinge 42. As shown in the drawings, the first and second brush arms 38, 30 extend forward from the rod 36 and have forward ends engageable with opposite ends of the brush for holding the brush therebetween for rotation about axis A.

Figure 4:
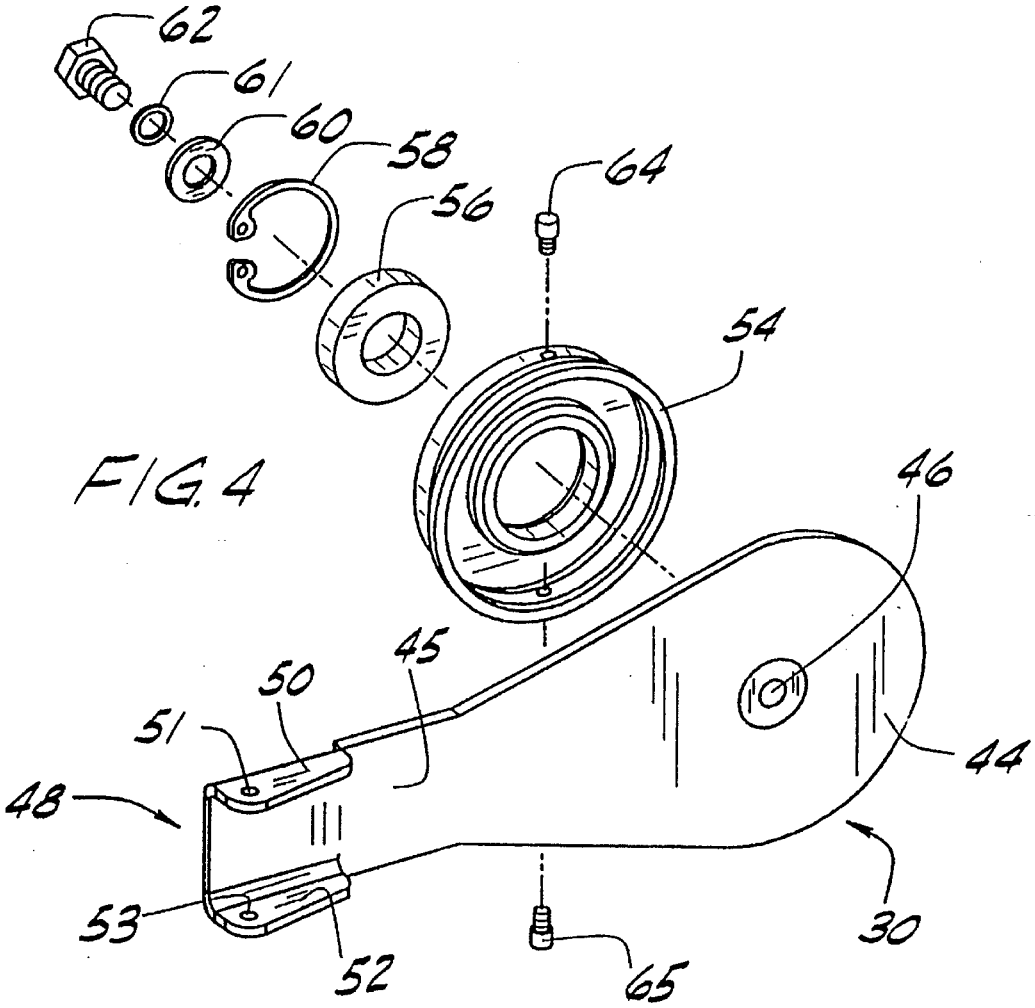
FIG. 4 is an exploded view of the present broom arm assembly.

The idler arm assembly 30 is depicted in detail in FIG. 4 and includes an idler plate 43 preferably formed of a suitable strength metal. The plate 43 includes an enlarged oval end 44 having a central bore 46, a neck portion 45, and a hinge coupler 48. The hinge coupler 48 is formed by a first transverse flange 50 formed on the end of the neck 45 and a second transverse flange 52 formed on the end of the neck 45 opposite the first flange 50. The first and second flanges each have a bore 51, 53 respectively, through which is received a pin 41 (FIG. 2) that couples the hinge coupler 48 of the idler arm assembly 30 with the hinge 42 of the support arm 36 for pivotal movement of the idler arm assembly 30 with respect to the hinge 42 and support arm 36 between an operative position (see FIG. 5) in which the forward end of the second brush arm 30 engages the end of the brush 26 and a non-operative position (FIG. 1) in which the forward end of the second brush arm is out-of-engagement with the brush to enable the brush to be installed and/or removed from the brush support system.

The idler arm assembly 30 further includes a brush retaining hub 54 that is mounted to the enlarged oval section 44. The hub 54 is mounted via bearing 56, two washers 60, 61, a retaining clip 58, and a bolt 62 that is threadedly received in the central bore 46. The hub 54 includes the two diametrically opposite pins or studs 64, 65 that are adapted to be received in the slots 72, 74 of the core 27 of the end 34 of the brush 26.

Figure 3:
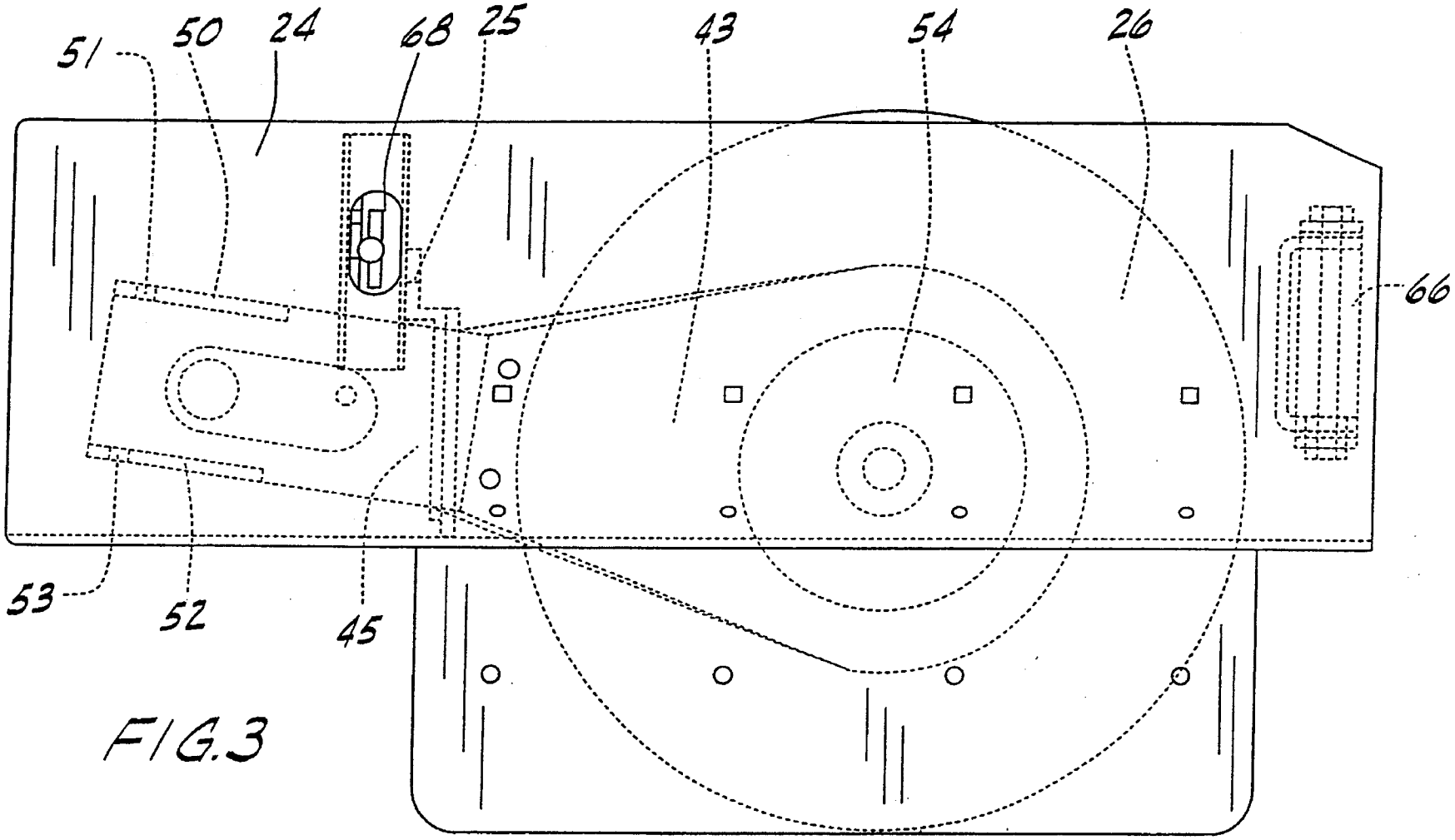
FIG. 3 is an enlarged side view of the brush access door showing the present broom arm in phantom.

With reference to FIG. 3, a side view of the access door 24 is shown with the arm assembly 30 in place against the brush 26. The inside of the door includes a passive retainer or keeper 25 that does not couple to the arm but abuts the neck 45 of the plate 43 for additional retention of the arm assembly 30. Also on the inside of the door 24 is a hinge 66 that is coupled to the frame of the sweeper for access to the arm assembly 30 and the brush 26. The retainer 25 may be independent of the door and thus may be attached to the frame or elsewhere. Additionally, instead of a passive keeper, a latch mechanism may be utilized that extends across the arm. Alternatively, the hinged arm assembly 30 may be spring biased against the brush 26. Thus, any passive or active method or mechanism may be used to retain the hinged arm assembly 30. However, it should be appreciated that the axial offset of the hinge 42 biases the hinged arm assembly 30 against the brush. Thus, a keeper or retainer is not especially needed.

Figure 6:
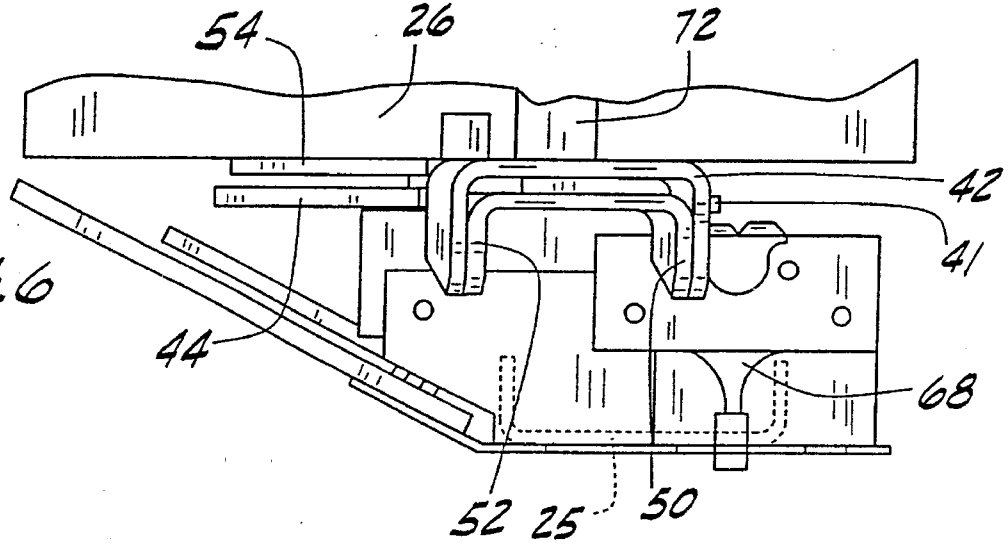
FIG. 6 is a view of the access door and present broom arm structure taken along line 6—6 of FIG. 5.
Figure 5:
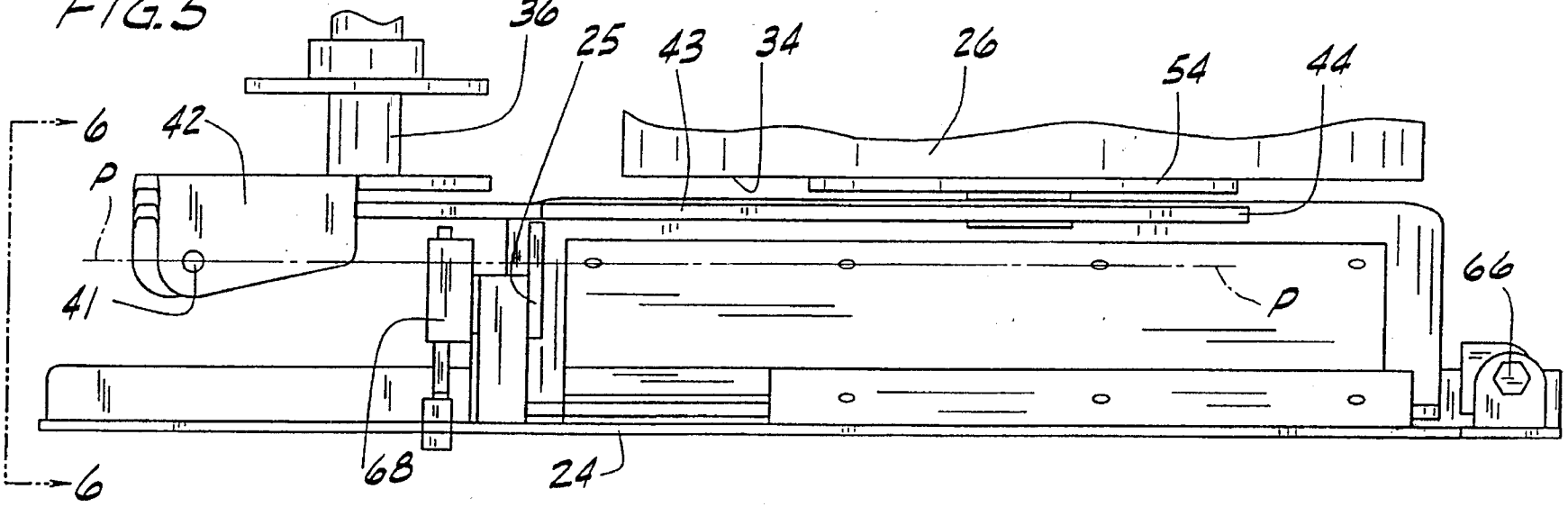
FIG. 5 is an enlarged top view of the access door and present broom arm structure.

With reference to FIGS. 5 and 6, it can be appreciated that hinge 42 has its pivot point around pin 41 and thus the plate 43 is axially inward relative to the pin 41. The pivot point axis 41 is therefore axially outwardly disposed relative to a plane defined by the end 34 of the brush 26. Stated another way, the pivot axis 41 lies in a generally vertical plane P (see FIG. 5) which extends in a generally front-to-rear diection with respect to the sweeper frame and which is spaced laterally outwardly (to the left as viewed in FIG. 5) away from the second (left as viewed in FIG. 5) end of the brush. It has been found that locating the pivot to the outside of the end plane of the brush, the arm assembly 30 is biased axially inwardly by the forward movement of the sweeper and counterclockwise movement of the brush.

While the foregoing is directed to the preferred embodiment of the present invention, other and further embodiments of the invention may be devised without departing from the basic scope thereof, and the scope thereof is determined by the claims which follow.

What is claimed is:

1. An industrial sweeper comprising:

a frame supported on front and rear wheels;

a hopper carried by said frame, said hopper having an inlet;

a cylindrical brush having first and second ends;

a brush support system affixed to the frame for supporting the brush in a position adjacent said hopper inlet for rotation about a generally horizontal axis extending in a side-to-side direction with respect to the frame;

said brush support system comprising a first brush arm extending in a generally forward direction with respect to the frame and having a forward end engageable with the first end of the brush, and a second brush arm extending in a generally forward direction with respect to the frame and having a forward end engageable with the second end of the brush, said brush arms combining to hold the brush therebetween for rotation about said generally horizontal axis;

a hinge mounting the second brush arm on the brush support system for pivotal movement of the arm about a pivot axis between an operative position in which the forward end of the second brush arm engages the second end of the brush and a nonoperative position in which the forward end of the second brush arm is out of engagement with the brush to enable the brush to be installed and/or removed from the support system;

said pivot axis lying in a generally vertical plane extending in a generally front-to-rear direction with respect to the frame, said plane being spaced laterally outwardly away from said second end of the brush whereby movement of the sweeper in a forward direction tends to bias the forward end of the second brush arm inwardly with respect to the brush toward its said operative position; and a retainer for retaining said second brush arm in said operative position.

2. A sweeper as set forth in claim 1 wherein said brush support system comprises a generally horizontal rod affixed to the frame rearwardly of the brush in a position in which the rod extends generally parallel to the axis of rotation of the brush, means mounting the first brush arm on the rod adjacent one end of the rod, and means mounting said hinge and said second brush arm on the rod adjacent an opposite end of the rod.

3. A sweeper as set forth in claim 1 further comprising a door on the frame moveable between an open position for accessing the second brush arm and the brush, and a closed position, said retainer being mounted on the door and being engageable with the second brush arm when the door is closed for retaining the second brush arm in its said operative position.

4. A sweeper as set forth in claim 3 wherein said retainer comprises a keeper on an inside surface of the door, said keeper being adapted to abut a portion of said second brush arm when the door is closed.

5. A brush support system for an industrial sweeper of the type having a frame supported on wheels, said brush support system comprising:

a support adapted to be affixed to the frame;

a cylindric brush having first and second ends;

a first brush arm extending from the support in a generally forward direction and having a forward end engageable with the first end of the brush, and a second brush arm extending from the support in a generally forward direction and having a forward end engageable with the second end of the brush, said brush arms combining to hold the brush therebetween for rotation about a horizontal axis; and a hinge mounting the second brush arm on the support for pivotal movement of the arm about a pivot axis between an operative position in which the forward end of the second brush arm engages the second end of the brush and a non-operative position in which the forward end of the second brush arm is out of engagement with the brush to enable the brush to be installed and/or removed from the brush support system;

said pivot axis lying in a generally vertical plane extending in a generally front-to-rear direction with respect to the brush support system, said plane being spaced laterally outwardly away from said second end of the brush whereby when the brush support system is installed on a sweeper, movement of the sweeper in a forward direction tends to bias the forward end of the second brush arm inwardly with respect to the brush toward its said operative position.

6. A sweeper as set forth in claim 5 wherein said support comprises a generally horizontal rod affixed to the frame rearwardly of the brush in a position in which the rod extends generally parallel to the axis of rotation of the brush, means mounting the first brush arm on the rod adjacent one end of the rod, and means mounting said hinge and said second brush arm on the rod adjacent an opposite end of the rod.

* * * * *